US005405209A

United States Patent [19]

Johns et al.

[11] Patent Number: 5,405,209

[45] Date of Patent: Apr. 11, 1995

[54] PAPER BINDER FOR FOLDERS

[76] Inventors: Darby R. Johns; Yvonne D. Johns, both of 16 Heathfield Road, Heathfield SA 5153, Australia

[21] Appl. No.: 119,171

[22] PCT Filed: Mar. 16, 1992

[86] PCT No.: PCT/AU92/00109

§ 371 Date: Jan. 10, 1994

§ 102(e) Date: Jan. 10, 1994

[87] PCT Pub. No.: WO92/16382

PCT Pub. Date: Oct. 1, 1992

[30] Foreign Application Priority Data

Mar. 21, 1991 [AU] Australia ..... PK5208

[51] Int. Cl.[6] ..... B42F 3/04

[52] U.S. Cl. ..... 402/28; 402/26; 402/68

[58] Field of Search ..... 402/28, 68, 70, 73, 402/26, 29, 30

[56] References Cited

U.S. PATENT DOCUMENTS

| | | | |
|---|---|---|---|
| 1,344,971 | 6/1920 | Allison . | |
| 2,855,935 | 10/1958 | Ham et al. . | |
| 3,503,695 | 3/1970 | Giampa | 402/68 X |
| 4,790,680 | 12/1988 | Givati et al. | 402/68 X |

FOREIGN PATENT DOCUMENTS

| | | |
|---|---|---|
| 3614008 | 10/1987 | Germany . |
| 206055 | 11/1923 | United Kingdom . |
| 968999 | 9/1964 | United Kingdom . |

*Primary Examiner*—Willmon Fridie
*Attorney, Agent, or Firm*—Quarles & Brady

[57] ABSTRACT

A paper binder for folders, the binder comprising a U shaped loop (2) to be attached to the folder (1) by a clip (6). The loop is in two parts, one part (4) being rotatable in the clip, and the other part (3) non-rotatable in the clip. The two parts are releasably attachable to each other to allow sheets of paper to be placed on the non-rotatable part.

5 Claims, 2 Drawing Sheets

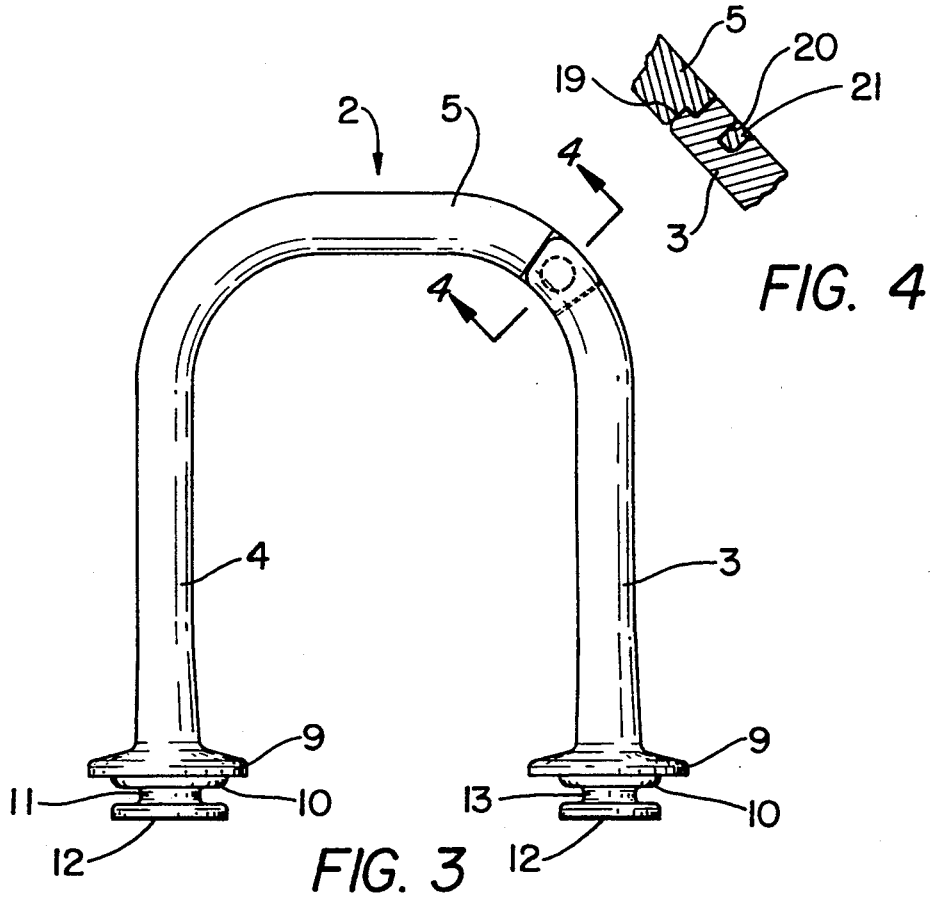
FIG. 4
FIG. 3
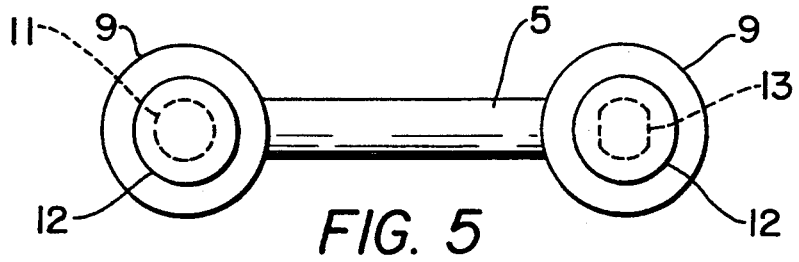
FIG. 5
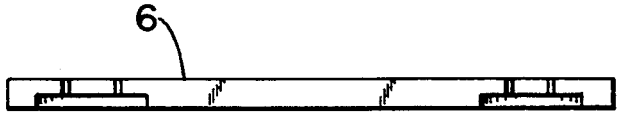
FIG. 6
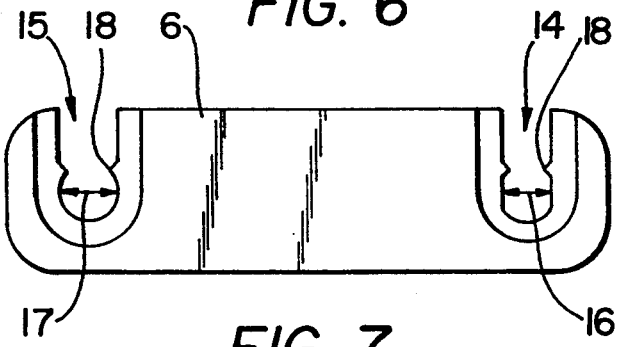
FIG. 7

PAPER BINDER FOR FOLDERS

This invention relates to a paper binder folder, more particularly to a binder which can be attached to a folder, and which binder can be readily opened and closed for the insertion of and removal of paper from the binder.

BACKGROUND OF THE INVENTION

Many types of folders or binders for the insertion of pages are well known. As far as is known these require a solid metal or plastic member along the spine of the folder to which the rings or other holding members are attached, and sometimes also contain some form of release mechanism in the form of levers, springs and the like. While these are satisfactory in many respects, sometimes the cooperating portions of the posts or rings become misplaced and thus do not completely meet so that a page or pages can become removed. Also the spring action of various binders such as three or four ring binders is very strong to such an extent that if the user is not careful injury can occur if the fingers are between the two portions of the ring closing on each other.

Also there are known paper binders having two flexible arms, the ends of which are pushed through a manila folder, and after the paper sheets are placed thereon the arms are bent parallel to the surface of the paper sheets, a metal washer desirably being placed over the arms before they are bent parallel to the paper. However these are only suitable for thin manila folders, and the arms often have the pointed ends upstanding to a degree so that injury to the users hands or fingers may occur.

U.S. Pat. No. 4,886,390 discloses a binder having a pair of rings loosely attached to a file or folder. The rings are split and provided with a hinge so that the rings can be opened at the split to receive perforations in the papers to be attached to it. A locking device is provided at the ends of the split to prevent circumferential rotation of the rings.

GB 2190331 shows a ring binder which includes a spine in the form of a rod and rings secured to the rod. Each ring is in two halves which are pivotally connected by a pivot pin at one end and are provided at the other end with hooks and recesses which are engageable with one another to secure the halves of the rings to each other.

ZA 8102974 is directed to a ring binder having fixed half-rings comprising pairs of prongs projecting from a base plate. The prongs of each pair are movable relative to each other from an open position to a closed position to define a continuous ring.

BRIEF DESCRIPTION OF THE INVENTION

It is an object of this invention to provide a binder for holding papers which will overcome one or more deficiencies of the known form of binders.

It is a further objection of this invention to provide U-shaped paper binder loops which are attached to one leaf of the cover without the requirement of a spine or other longitudinal strengthening member on the cover.

A further object of the invention is to provide the U-shaped binder loops with means whereby each loop is formed in two portions with one portion being able to pivot relative to the other so that the paper sheets can be inserted thereon.

A still further object is to provide that while one portion of the U-shaped loop can be pivoted relative to the other, the other U-shaped loop may not be rotated or pivoted relative to the cover.

Thus there is provided according to the invention a paper binder, the paper binder comprising at least one U-shaped loop adapted to be attached to a leaf of a folder, said U-shaped loop having a first portion and a second portion, said first portion being fixedly attached to said leaf, and said second portion pivotally attached to said leaf so that the second portion may be pivoted relative to the first portion to open and releasably engage the first portion to close the U-shaped loop.

Preferably the two portions of the U-shaped loop can be attached to the leaf by a clip engaging both portions of the side of the leaf opposite to the U-shaped loop.

BRIEF DESCRIPTION OF THE DRAWINGS

In order to more fully describe the invention reference will now be made to the accompanying drawings in which:

FIG. 3 is a side view of one of the U-shaped loops, FIG. 4 is a partial section along the lines 4—4 of FIG. 3, FIG. 5 is a bottom view of FIG. 3, FIG. 6 is a side view of a locking clip, and FIG. 7 is a plan view of the clip of FIG. 6.

Referring to FIGS. 1 and 2 of the drawings them is shown a cover 1 including the U-shaped loops 2 on which the pages of paper can be attached. Each U-shaped loop has two legs 3 and 4, the leg 3 being fixedly attached-to the cover 1 while the leg 4 can be pivoted or rotated to allow the pages of paper to be placed over the leg 3. The leg 4 has a generally laterally extending portion 5 the end of which can be releasably attached to the end of the leg 3. As show in FIG. 1 the legs are retained on the cover by a clip 6 as more fully described later.

Figure 1:
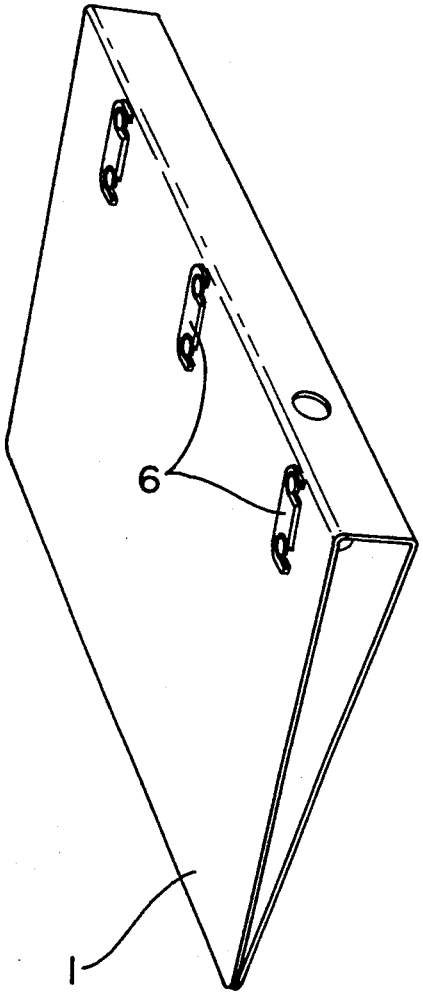
FIG. 1 is a view of the back of the folder incorporating the invention.
Figure 2:
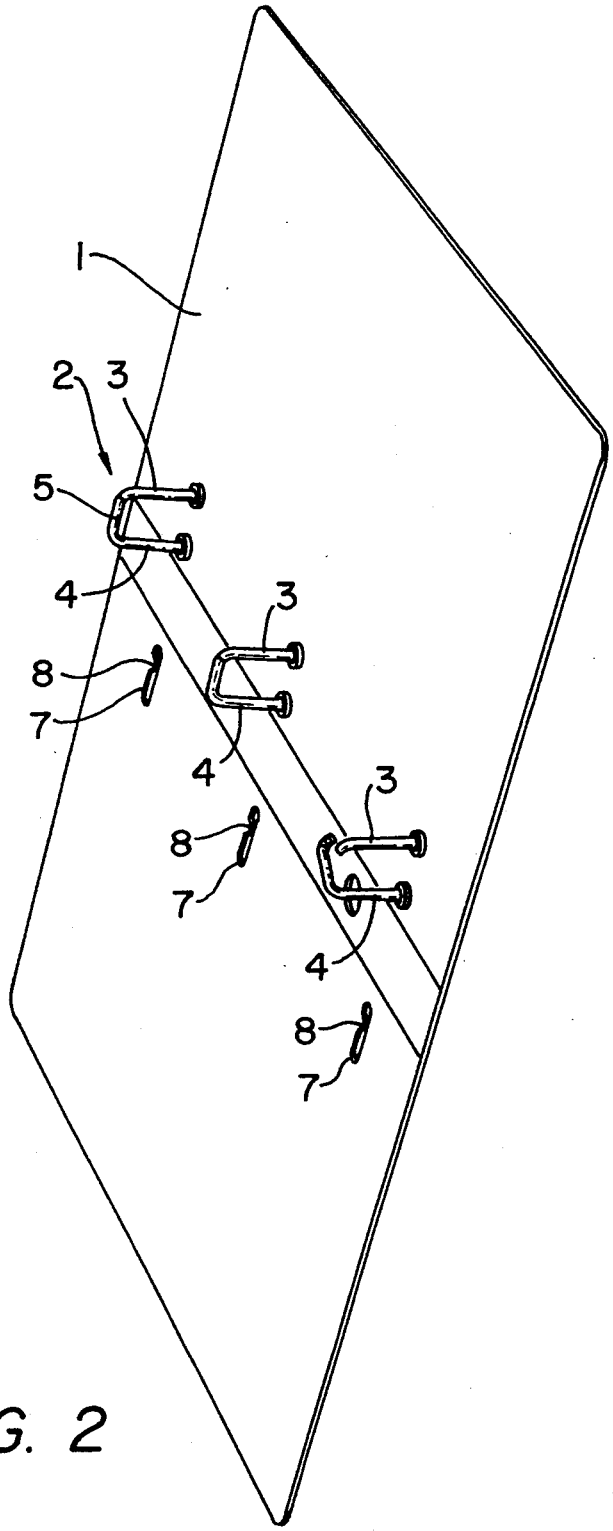
FIG. 2 is a view of the open folder showing one of the U-shaped loops in the open position.

The cover 1 has slots 7 on the leaf of the cover opposite each of the U-shaped loops, so that when the leaves of the cover are closed-over each other, the laterally extending portion 5 passes through the slot. However each slot has an extending lip 8 which will engage under the laterally extending portion 5 when the leaves of the cover are in the closed position to this releasably hold the covers in the closed position. The cover is formed of a relatively rigid material to fully protect the contents of the cover, and thus as the leaf of the cover is closed, the lip 8 will clip under the laterally extending portion 5.

FIGS. 3 to 5 show in more detail the U-shaped loops 2. Each of the legs 3 and 4 is provided at their lower end with a flange 9 to engage the surface of the cover. Beneath the flange 9 there is a boss 10 to engage in the hole in the cover 1, and further beneath the boss there is a reduced portion 11 over which the clip 6 engages, the clips being retained in position by a further flange 12. As shown in FIG. 5 the reduced portion 11 of the leg 4 is circular, while the reduced portion 11 of the leg 3 has flat sides 13.

As noted above the legs are retained in position by the clip 6 which has shaped apertures 14 and 15. The aperture 15 has a dimension 16 corresponding to the width of the flats 13 on the leg 3 while the aperture 15 has a dimension 17 corresponding to the diameter of the reduced portion 11 of the leg 4. Each aperture 14 and 15 has lips 18 to act as clips to engage over the reduced portions 11 of the respective legs 3 and 4 so that the clip can be clipped over the reduced portions to retain the legs in position on the cover.

Thus it will be seen that the leg 3, by virtue of the flats 13 and the shape of the aperture 14, is fixedly secured in the cover 1 and cannot rotate, while the leg 4 by virtue of the circular shape of the reduced portion 11 and the circular recess in the aperture 15 is able to be rotated. Hence the leg 4 can be rotated away from the leg 3 to allow paper to be placed over the leg 3.

The leg 3 at its upper end has means to releasably engage the end of leg 4 at the end of the laterally extending portion 5, this being at the curved portion of the loop 2. As shown in FIG. 4 the end of the portion 5 has a cut out portion 19 with an hole 20, while the end of the lag 3 has a corresponding reduced portion 21 with a peg 22 to engage in the hole 20. Thus the leg 4 can be pivoted to be releasably engaged with the fixed leg 3, the engagement of the peg 22 in the hole 20 being such that the peg 22 engages in the hole 20 with an interference fit, or with a clipping action so that the leg 4 is retained in position, but can be released therefrom to allow the leg 4 to be rotated to allow the placement and removal of paper from the leg 3. As the two legs are stepped or provided with the above described recesses, it will be seen that the overlapping portion of the two legs has the same outside dimensions so that there is the facility of paper being easily moved from one leg to the other as the pages in the cover are being read.

By the present invention the U-shaped loops can readily attached to a folder as desired, using either 2 or 3 or 4 on a binder as desired. By the use of a relatively rigid cover material and the use of the clip on the outside of the cover, it is not necessary for there to be a rigid element or spine or other member extending the length of the cover to which the U-shaped loops are to be attached.

The U-shaped loops can be formed of metal, but it preferred that these be formed of one of the known plastics material suitable for this purpose. The covers can be sold with the U-shaped loops already attached to the covers, or preferably the U-shaped loops are supplied separately of the covers thus saving transport and storage space and costs, for the covers can then be supplied in a flat condition with the user attaching the U-shaped loops to the covers.

The exact form of the U-shaped loops can be varied, as long as the two portions can be releasably joined together in use. Thus the leg 4 can be semicircular at its upper end and the leg 3 may be straight without any curved portion at its upper end. Thus as long as the legs can be clipped together, and one leg can be pivoted or swung away from the other, that there is provided a cover and retaining members for the paper sheets inserted into the cover.

Although one form of the invention has been described in some detail, it is to be realised that the invention is not to be limited to the precise details described, but can include modifications and variations falling within the scope of the appended claims.

We claim:

1. A paper binder for folders, the paper binder comprising at least one U-shaped loop, said U-shaped loop having a first portion and a second portion, said first portion comprising a first generally vertical leg, and said second portion comprising a second generally vertical leg with transverse portion extending to be releasably engageable with said first leg, characterized in that said first and second legs are attachable to a leaf of a folder by clip means engaging both legs to retain both legs on a leaf of a folder, said clip means preventing rotation of said first leg while allowing rotation of said second leg about its vertical axis, so that said transverse portion is engageable with and releasable from said first leg with a purely rotatable motion.

2. A paper binder as defined in claim 1 further characterised in that said first leg has a non-circular portion engaging a co-operating non-circular aperture in said clip so that said first leg cannot rotate relative to the leaf of the cover.

3. A paper binder as defined in claim 1 further characterised in that the second leg has a circular portion engaging a part circular recess in the clip so that the second leg can rotate relative to the cover.

4. A paper binder as defined in claim 1 further characterised in that the end of the transverse portion is provided with a peg to releasably engage in a hole in the end of the first leg so that the second leg is releasably engaged with the first leg.

5. A paper binder as defined in claim 1 when attached to a cover, characterised in that the cover has a slot corresponding to the transverse portion of the second leg, the transverse portion protruding through the slot, the slot having a lip to engage under a portion of the transverse portion to retain the cover in the closed position.

* * * * *